US005125311A

United States Patent [19]

Boulanger et al.

[11] Patent Number: 5,125,311

[45] Date of Patent: Jun. 30, 1992

[54] GUITAR, AND METHOD OF MANUFACTURING GUITARS

[75] Inventors: Stephen J. Boulanger, La Habra; John F. Page, Anaheim Hills; John W. Black, Corona, all of Calif.

[73] Assignee: Fender Musical Instruments Corporation, Scottsdale, Ariz.

[21] Appl. No.: 716,900

[22] Filed: Jun. 18, 1991

Related U.S. Application Data

[63] Continuation-in-part of Ser. No. 642,003, Jan. 16, 1991, abandoned.

[51] Int. Cl.[5] ..... G10D 3/00

[52] U.S. Cl. ..... 84/291; 84/293

[58] Field of Search ..... 84/267, 290, 291, 292, 84/293

[56] References Cited

U.S. PATENT DOCUMENTS

| | | | |
|---|---|---|---|
| 498,113 | 5/1993 | Hartmann | 84/293 |
| 2,795,988 | 6/1957 | Maccaferri | 84/293 |
| 2,972,923 | 2/1961 | Fender | 84/313 |
| 3,196,730 | 7/1965 | Daniel | 84/293 |
| 3,204,510 | 9/1965 | Hopf | 84/291 |
| 3,302,507 | 2/1967 | Fender | 84/267 |
| 3,396,621 | 8/1968 | Dycus | 84/293 |
| 3,439,570 | 4/1969 | Lee | 84/293 |
| 3,550,496 | 12/1970 | Fender | 84/293 |
| 3,678,795 | 7/1972 | Fullerton | 84/293 |
| 3,911,778 | 10/1975 | Martin | 84/267 |
| 4,027,570 | 6/1977 | Rendell | 84/293 |
| 4,144,793 | 3/1979 | Soika | 84/291 |
| 4,290,336 | 9/1981 | Peavey | 84/291 |
| 4,334,452 | 6/1982 | Morrison | 84/1.16 |
| 4,432,267 | 2/1984 | Feller | 84/293 |
| 4,538,497 | 9/1985 | Smith | 84/291 |
| 4,557,174 | 12/1985 | Gressett | 84/293 |
| 4,793,236 | 12/1988 | McGuire | 84/293 |
| 4,803,906 | 2/1989 | Fender | 84/293 |
| 4,896,578 | 1/1990 | Marx | 84/313 |
| 4,905,563 | 3/1990 | Davies | 84/291 |

FOREIGN PATENT DOCUMENTS 2045993 3/1980 United Kingdom .

OTHER PUBLICATIONS

A drawing showing the neck joint construction of an early Gibson guitar.

*Primary Examiner*—L. T. Hix
*Assistant Examiner*—Howard B. Blankenship
*Attorney, Agent, or Firm*—Richard L. Gausewitz

[57] ABSTRACT

A set-neck guitar in which the inner neck end has a tongue that seats in and is glued in a pocket in the body and in a protuberance on the body. Corresponding sidewalls of the tongue and pocket are parallel to the center line of the body, while other sidewalls are at an angle thereto so as to create a wedge relationship. A cam and bearing element is provided to force the wedge surfaces together and improve the connection. The underside of the protuberance on the body is carved back, as is part of the neck, to create a generally integral-seeming joint. Crush points are provided to facilitate the operation and enhance esthetics.

30 Claims, 4 Drawing Sheets

FIG. 2.
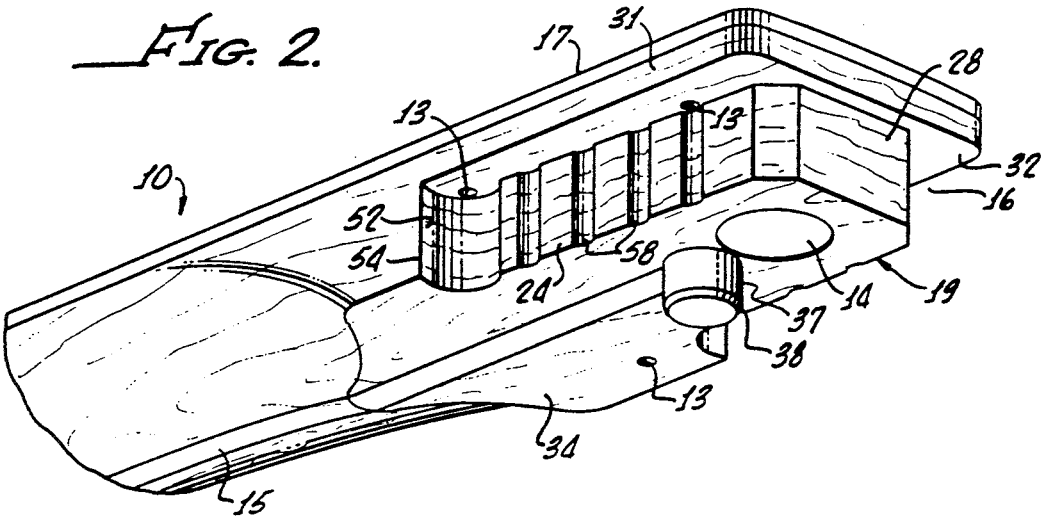
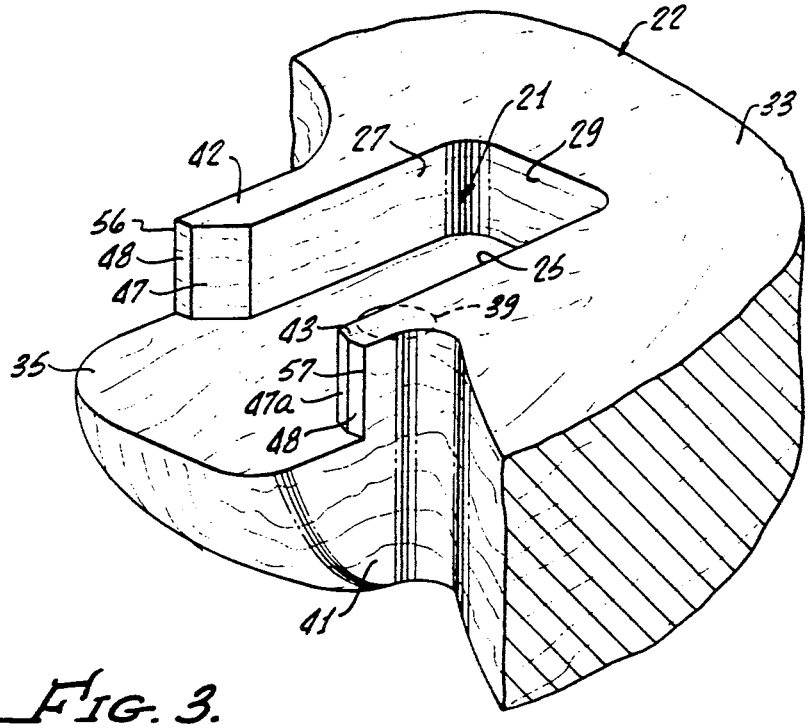
FIG. 3.
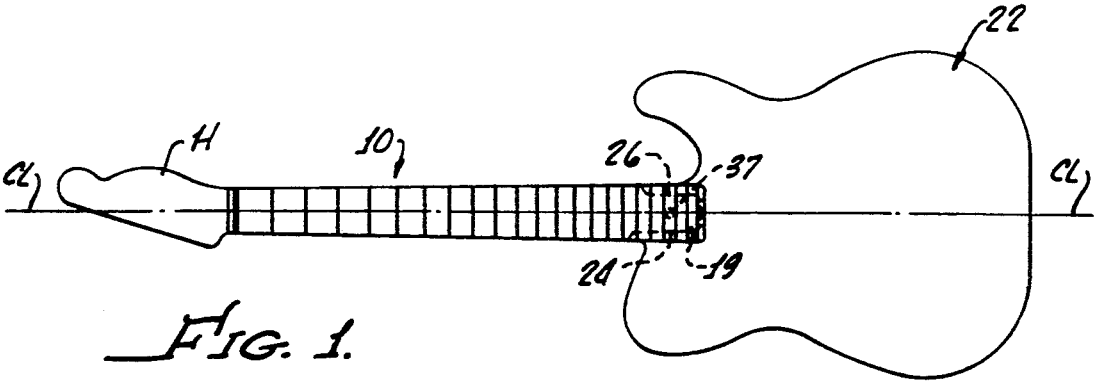
FIG. 1.

GUITAR, AND METHOD OF MANUFACTURING GUITARS

CROSS REFERENCE TO RELATED APPLICATION

This is a continuation-in-part of now-abandoned patent application Ser. No. 07/642,003, filed Jan. 16, 1991, for Guitar, and Method of Manufacturing Guitars.

BACKGROUND OF THE INVENTION

The neck joints of solid-body electric guitars have conventionally been made by screws, although glued joints ("set necks") have also been used. Advantages of the screw-connected neck joints of solid-body electric guitars include economy of production, and ease of alignment of the neck relative to the center line of the guitar body. Relative to the former of these factors, it is emphasized that the economy relates to the joint itself, not to the neck at such. (The neck of an electric guitar is a complex, precision component the proper construction of which is crucial to good guitar playing.) Relative to the latter of the stated factors, if the neck was somewhat out of alignment relative to the body, the screws could be loosened somewhat and the neck slightly shifted in order to achieve the desired alignment.

Screw-connected neck joints of solid-body electric guitars have certain disadvantages. The neck-body connection in a screwed-joint guitar is not as rigid as in a guitar where the joint is permanently made by adhesive. This affects the sustain or dwell of the strings. Another disadvantage is that the protuberance on the guitar body, and which underlies the neck pocket, conventionally has a relatively square-cornered outer end that tends to block the hand of the guitarist when he or she seeks to put his or her fingers on the frets that are relatively close to the bridge. It is desirable to have the body region that underlies the inner end of the neck be rounded and tapered, so that the musician can readily and comfortably move his or her hand close to the bridge.

Another consideration relative to screw-connected necks for solid-body electric guitars is that the joint regions where the necks first reach the protuberances on the bodies, are often not aesthetically pleasing, smooth or beautiful. It is important that continuity of surfaces, absence of cracks, smoothness, etc., be achieved everywhere on each guitar--not excluding the indicated region.

Because of the above-stated disadvantages of screw-connected necks, it is desired by many that the neck joints be made by using adhesive. However, as a practical matter, it is difficult to provide a glued neck joint in a solid-body electric guitar that will reliably, guitar after guitar, cause the center line of the neck to be in precise alignment with the center line of the guitar body. Unlike screw-connected necks, it is not possible to make minor adjustments in neck alignment after the strings are mounted on the guitar. To the contrary, the neck must be properly aligned with the body and permanently secured to it, with assurance that when the strings are eventually mounted they will be exactly where they should be relative to the neck, and vice versa. To state but one example, it would be unsatisfactory if the string adjacent one edge of the neck were closer to such edge than is the string adjacent the other edge of the neck. This would not only look terrible, but would not perform at all satisfactorily, one example being that bending of the strings would be affected.

SUMMARY OF THE INVENTION

One aspect of the present method involves routing out marginal regions of the inner end of a previously-manufactured standard neck for a solid-body guitar to which such neck is conventionally screw connected. The routing is on the underside thereof so as to form a tongue having a certain shape. This tongue has predetermined dimensions and has a width narrower than the width of neck pockets in guitar bodies to which the necks are conventionally screw connected. Such tongue is then inserted into a tongue pocket in a guitar body, such tongue pocket also being narrower than the width of neck pockets in the solid bodies to which the necks are screw connected. The particular shapes of the tongue and its pocket, and the manner of connection of tongue to body, are indicated below and achieve alignment, strength, and beauty in simple and effective ways.

The sides of the tongue converge gradually, in a direction away from the head end of the neck. Stated more definitely, one such side converges gradually toward the other, such other side being parallel to the center line of the neck. The sides of the tongue pocket in the body are correspondingly configured, one side converging toward the other that is parallel to the center line of the body. The tongue is glued to surfaces of the tongue pocket while the described sides are in close flatwise engagement with each other, to achieve a strong glued joint and to achieve correct permanent alignment of the center line of the neck with the center line of the body.

In accordance with another aspect of the method and apparatus, the close abutment is achieved by a camming action, using a pin that extends into the tongue and into the body. The pin and the bore therefor are so constructed that forcing of the pin into the bore causes very tight pressing of the tongue into the tongue pocket, and maintains the tongue thus pressed in the tongue pocket while the glue is drying and thereafter. Only one clamp is employed in the manufacturing operation, this being the clamp that holds down the butt end of the neck; there is no need for a clamp to apply pressure longitudinally of the neck.

In accordance with another aspect of the apparatus and method, sharp edges are formed where side edges of the neck meet end regions of a protuberance on the solid body. These sharp edges are so located and constructed that they are compressed or crushed in response to the last portion of the forcing of the tongue into the tongue pocket. This creates very smooth junction regions characterized by the absence of gaps and imperfections. The described crushing makes a "fine line" joint possible. The outer-bottom portion of the protuberance on the body is rounded to facilitate reaching of the frets nearest the bridge, and for aesthetic reasons.

Grooves of divots are spaced around the abutting tongue and pocket surfaces, to allow glue to migrate during clamping. This effectively distributes glue in an even manner, while still maintaining wood-to-wood contact for excellent energy transfer between neck and body.

BRIEF DESCRIPTION OF THE DRAWINGS

FIG. 1 is a top plan view of a guitar body and guitar neck assembled with each other in accordance with the present invention;

FIG. 2 is an isometric view, as viewed from below, of the inner end of a guitar neck incorporating the present invention, but with the frets unshown;

FIG. 3 is an isometric view, as viewed from above, of the pocket region of a guitar body, adapted to receive the tongue shown in FIG. 2;

DETAILED DESCRIPTION OF THE PREFERRED EMBODIMENT

The present apparatus and method may be employed relative to numerous types of guitars by numerous manufacturers. It is here described as employed relative to a solid body electric guitar, one early example of which is shown in U.S. Pat. No. 2,972,923, issued Feb. 28, 1961, inventor C. L. Fender. The greatly preferred neck is shown and described in U.S. Pat. No. 4,557,174, issued Dec. 10, 1985, inventor C. A. Gressett, Jr. Both of said patents are hereby incorporated by reference herein.

The present invention is applicable to both standard (treble) guitars and bass guitars; the word "guitar" applies to both in this specification and claims.

Figure 7:
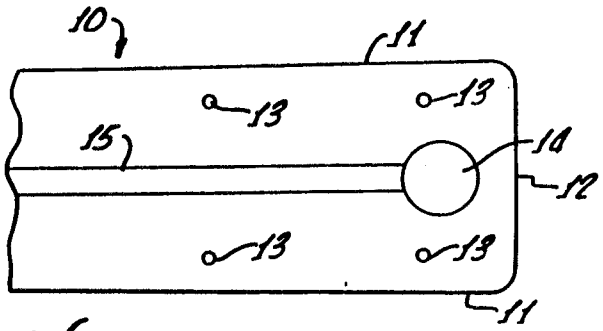
FIG. 7. (PRIOR ART)
FIG. 7 is a bottom plan view of the inner end of a neck adapted to be connected by screws to a guitar body.

Referring first to FIG. 7 of the present application, this is the inner end of a neck 10 manufactured in accordance with the U.S. Pat. No. 4,557,174. As shown, the neck end has vertical sidewalls 11 and an end wall 12, disposed at substantially right angles to each other. As is standard in the art, this inner end is mounted in a neck pocket formed in the solid body of the guitar being manufactured. The dimensions of the neck pocket are such that the neck pocket receives, relatively snugly, the illustrated inner end. As shown, the inner neck end has screw holes 13 adapted to receive the screws which secure the inner neck end to the solid body. Also shown in FIG. 7 is the bottom end of the retaining nut 14 that connects to the truss rod in the neck and prevents such truss rod from rotating and also prevents the truss rod end from moving longitudinally (the retaining nut is shown and described relative to number 31 in the cited U.S. Pat. No. 4,557,174). Also shown in FIG. 7 is the "skunk stripe" 15 that conceals the truss rod (such skunk stripe being a strip of wood described relative to number 48 in the cited U.S. Pat. No. 4,557,174).

A batch of guitar necks that are largely completely manufactured, but normally except for finishing, etc., for mounting on solid bodies by means of screws (for example, necks shown and described in U.S. Pat. No. 4,557,174 and relative to FIG. 7 of the present application) are further manufactured in simple and economical ways for effective mounting on guitar bodies by gluing. The necks are identical, whether secured by screws or by gluing, the only differences preferably being those described below.

Figure 4:
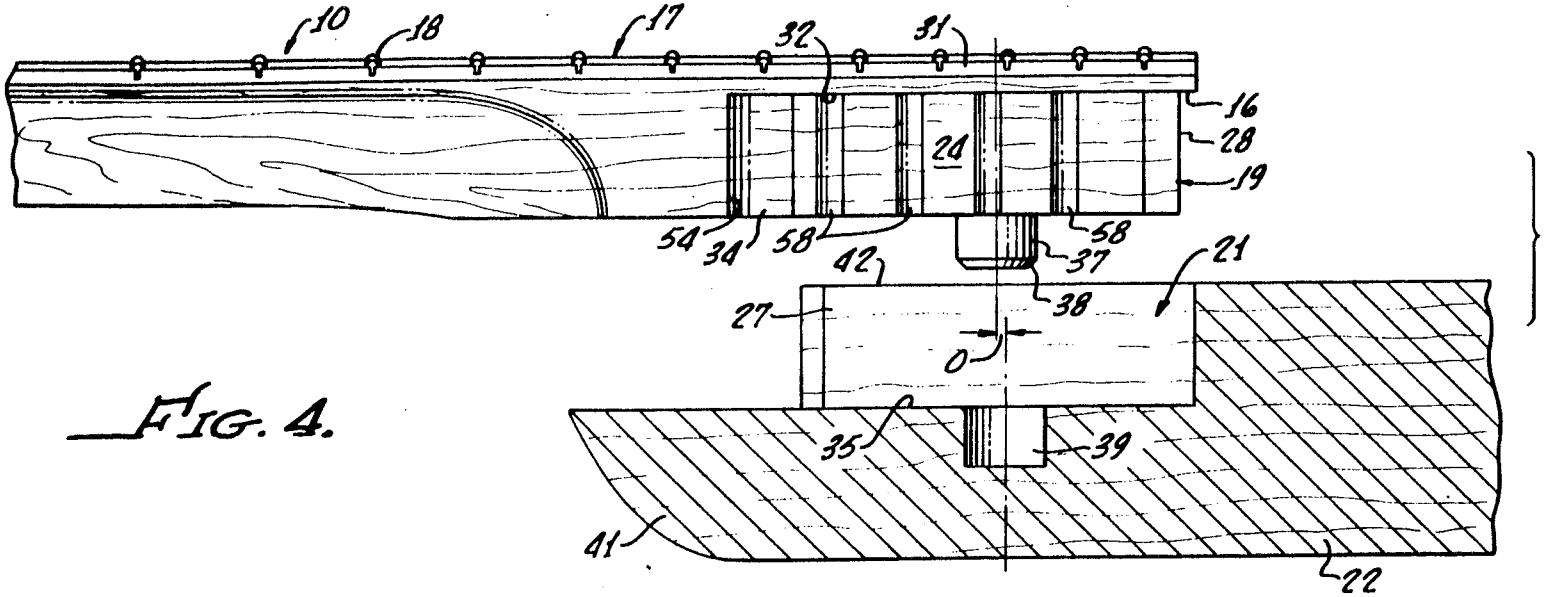
FIG. 4 is a view, partially in vertical section and partially in side elevation, showing the neck end of FIG. 2 as related to the guitar body portion of FIG. 3.
Figure 5:
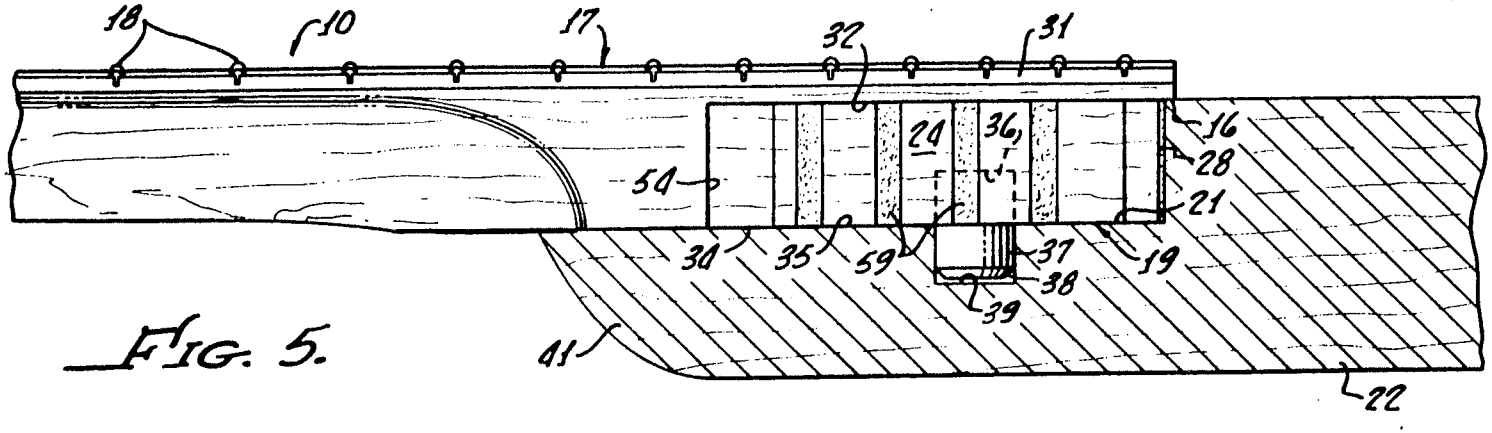
FIG. 5 corresponds to FIG. 4 but shows the parts in assembled positions.

To adapt any number of complete (except for finishing, etc.) previously-manufactured necks for adhesive connection to guitar bodies, two additional steps are performed relative to each neck. The first such additional step is to rout out marginal regions of the lower portion of the inner neck end to form indented side and end regions 16 of precisely predetermined configuration (FIG. 2). Very preferably, the routing is done to remove wood from the main body of the neck 10, not from the fretboard 17 which is adhesively secured to the upper surface of the main neck body and incorporates the frets 18 of the neck (FIGS. 4 and 5). The routing forms a tongue 19 at the inner neck end, the tongue having a special shape and being adapted to fit into a tongue-receiving groove or pocket 21 (FIG. 3) of the solid guitar body 22.

Both the tongue 19 and its pocket 21 extend longitudinally of the body and neck of the guitar. The pocket 21 is adapted to snugly receive the tongue 19, in glued relationship such that the neck and body are correctly aligned, as described below.

Figure 6:
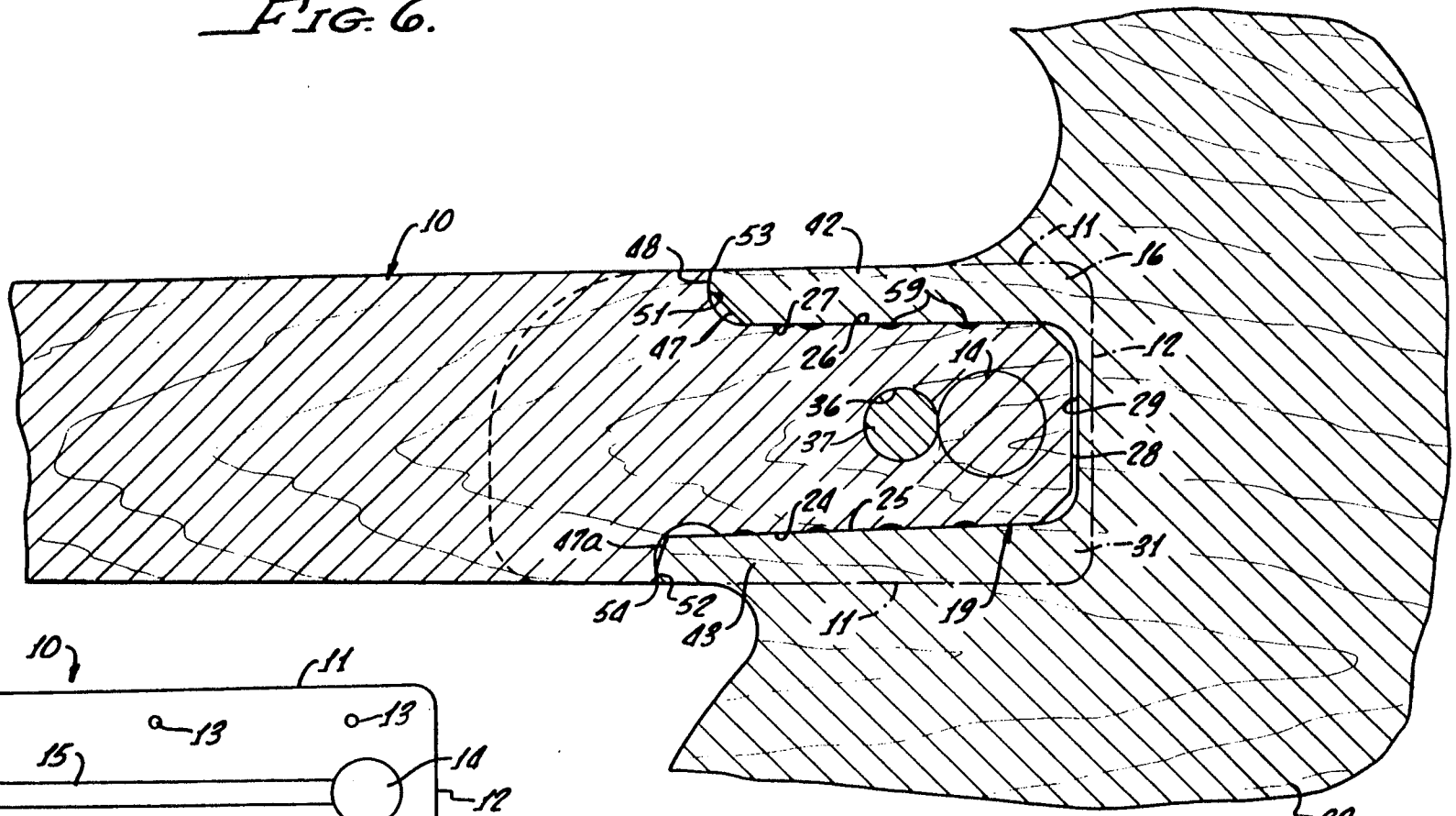
FIG. 6 is a horizontal sectional view, looking downwardly, of the assembled components of FIG. 5, the truss rod being unshown.

Thus, tongue 19 has a planar vertical side 24 (FIG. 2) adapted to be in flatwise engagement with a planar vertical side 25 (FIGS. 3 and 6) of tongue pocket 21. On its other longitudinal side, tongue 19 has a planar vertical side 26 (FIG. 6) adapted to be in flatwise engagement with a planar vertical side 27 of pocket 21 (FIGS. 3 and 6). The end 28 of the tongue preferably does not engage the end 29 of pocket 21, even when the parts are fully assembled as shown in FIG. 6.

Because of the above-described routing of neck material, to form the indented side and end regions 16, the neck end has a peripheral ledge 31 at its sides and end. Preferably, the ledge is composed of the body of the neck and the end of fretboard 17. The routing is so performed that the underside 32 of ledge 31 is flat, being parallel to and adapted to flatwise engage the upper surface 33 of body 22 (FIG. 5). The routing is also such that, at the same time that surfaces 32,33 come into flatwise engagement, the bottom surface 34 of tongue 19 (and adjacent regions) comes into flatwise engagement with the bottom surface 35 of pocket 21 (and adjacent regions).

It is pointed out that the side and end walls of ledge 31 are what remain of the side and end walls 11,12 (FIG. 7) of the neck as originally formed. Thus, these side and end walls 11,12, are indicated in phantom line in FIG. 6.

Further Description of Method and Apparatus for Creating a High-Quality Strong, Aligned, Glued Joint Sidewalls 24,26 of tongue 19 are oriented in wedge relationship to each other, in that there is convergence in a direction away from the head end of the guitar neck. Sidewalls 25,27 of pocket 21 are correspondingly wedge related, being adapted to be engaged simultaneously by the respective sides 24,26 in flatwise relationships as the neck 10 is moved longitudinally toward the bridge region of the guitar body. It is possible to make the wedging action terminate by engagement of surfaces 28,29 with each other, but this is not preferred. A greatly better way of terminating the wedging action includes performing the above-indicated second manufacturing step relative to the otherwise completed (except for finishing) neck the inner end of which is shown in FIG. 7.

This second manufacturing operation comprises drilling a hole 36 (FIG. 6) perpendicular to the bottom surface 34 of the neck end and generally in the center thereof, the hole being preferably adjacent retaining nut 14. The hole 36 is, in part, through the skunk stripe 15, the presently-preferred hole diameter being one-half inch. Into the hole 36 (FIG. 6) is snugly inserted, and preferably glued, a combination bearing and cam pin 37 preferably formed of steel. A satisfactory depth of hole 36 is approximately ⅜ inch, into which the pin 37 is inserted to full depth. Pin 37 extends out of hole 36 for preferably about the same distance.

As shown in FIGS. 2, 4 and 5, there is a cam edge or bevel 38 at the outer end of pin 37.

Referring to FIG. 4, there is shown a bore 39 in body 22, adapted to receive snugly the cam and bearing pin 37. In accordance with one aspect of the present invention, the center of pin 37 is not aligned with the center of bore 39 when the tongue 19 has been pushed into pocket 21 as far as it will go in response to reasonable longitudinal pressure exerted manually. Thus, the offset indicated at "0" in FIG. 4 is present between the centers of the pin and the associated bore 39 in the body. (It is to be understood that the showing of FIG. 4 illustrates the neck completely above the body, this being for purposes of clarity of illustration.)

The amount of offset O is empirically determined, being typically about 0.010–0.015 inch. The width of each side of the bevel or cam edge 38 is equal to or greater than the amount of offset O. The empirical considerations which determine the amount of offset include the type of wood, and the desired amount of "crushing" of edges described below. There is achieved very tight flatwise engagement of the wedge-related surfaces, plus edge crushing subsequently described.

When tongue 19 has been longitudinally inserted manually as far as it will go with reasonable manual pressure, with the bottom end of pin 37 resting on surface 35, the neck end is actuated downwardly to create a cam action between cam or bevel edge 38 and the left side (FIGS. 4 and 5) of bore 39. This cam action forces the wedging surface into much tighter engagement in that the neck end is shifted to the right (FIGS. 4 and 5) the additional distance determined by offset O.

The cooperation between the pin 37, the bore walls for the upper and lower portions of the pin, and the wedge surfaces is such that tongue 19 is very tightly engaged with wedge surface means as described below. Only one clamp need be employed while the glue dries, this clamp being a C-clamp that presses down against the upper surface of the neck end and presses up against the lower surface of the guitar body region below pocket 21. No longitudinal clamping action is required.

In accordance with the best mode contemplated by the inventors, the C-clamp presses the neck end downwardly, for the full distance of downward neck movement, to cause the described cam action and then hold the parts tightly together while the glue dries.

In accordance with another aspect of the present invention, the described wedging action is not created by symmetrical wedging surfaces but instead by asymmetrical surfaces one of which is parallel to the center line of neck 10 or body 22. In the illustrated embodiment, surfaces 26 and 27 are accurately parallel to the center line "CL" (FIG. 1) of the guitar body and the neck, respectively. Surfaces 24,25, on the other hand, converge toward the neck or body center line in the direction away from the head H of the guitar (FIG. 1). The angle of such convergence is not great, being preferably about two degrees.

Prior to the assembly into the condition shown in FIG. 1 surface 26 is parallel to the neck center line, and surface 27 to the body center line. After assembly, the neck and body center lines become substantially coincident as shown at CL in FIG. 1.

Because guitar necks and bodies are made primarily of wood, and because wood often has variations, sanding is often performed to create a perfect fit between tongue 19 and the walls of tongue pocket 21. In the present guitar, such sanding is done substantially entirely on the inclined surface or side 24 of the tongue, and on pocket side 25, not on the straight (not converging) side 26 of the tongue or on the straight side 27 of the body. The straight sides 26,27 remain as reference surfaces which operate accurately to maintain the neck 10 in substantially perfect alignment with the center line CL (FIG. 1).

It is emphasized that even a slight amount of inclination of the neck relative to the center line is unsatisfactory, one reason being because the guitar strings would not be perfectly positioned relative to the fretboard 17. The neck 10 is so long that a fraction of a degree of inclination creates a seriously adverse problem and, typically, rejection.

Structure Permitting Practical Formation of a Joint Having Excellent Aesthetics The solid body 22 has a protuberance 41 at the outer end of the pocket 21. As shown in FIG. 3, part of the pocket 21 is in the main body 22 while another part of the pocket 21 is between walls 42,43 that are integral with the main body and that extend away from the center thereof—being generally parallel to pocket sides 25,27. The protuberance 41 is beneath at least the outer regions of walls 42,43, and also extends substantially further away from the center of the body (namely, toward the neck end of the guitar). The upper surface of protuberance 41 is the same as the bottom surface 35 of pocket 21, forming an extension of such bottom surface.

As shown in FIGS. 3 and 6, wall 43 extends farther toward head H than does wall 42. Furthermore, the tongue side 24 that tapers is longer than is the tongue side 26 that is parallel to center line CL (FIG. 1).

To improve greatly the aesthetics of the joints between the outer ends of walls 42,43, and the neck side regions immediately adjacent such outer ends, these adjacent elements are formed in special ways and caused to tightly contact each other in response to the above-described cam action created by bearing and cam pin 37.

Each wall 42,43 has a beveled corner surface **47,47*a* that facilitates entry of tongue 19 into pocket 21, and also has a square end surface 48** lying in one of two parallel planes that are each perpendicular to the center line CL.

The forward ends of the indented side and end region 16 of the neck are walls 51,52 that, at least at their portions adjacent the side walls of the neck, incline back toward the guitar body. Thus, very preferably, they are not in a plane perpendicular to the center line. Stated more definitely, and referring to FIG. 6, wall 51 extends outwardly and to the right relative to a plane (not shown) that is perpendicular to the center line on the neck. Similarly, wall 52 also extends outwardly and to the right relative to a plane perpendicular to such center line. The preferred angle of inclination, at regions adjacent the sides of the neck, is about two degrees.

Sharp corners 53,54 (FIG. 6) are formed on the sides of the neck, each corner being at the outer neck surface and at the end of the routed-out region 16. Corners 56,57 are formed on the body 22, as shown in FIG. 3, at the outer edges of end surfaces 48. The outer sides of walls 42,43 are flush with the outer sides of the guitar neck adjacent thereto, being coplanar therewith.

Thus, when tongue 19 is inserted substantially fully into pocket 21, the sharp edges 56 (FIG. 3) and 53 (FIG. 6) on one side of the guitar engage each other, and the sharp edges 57 (FIG. 3) and 54 (FIGS. 2 and 6) engage each other.

It is emphasized that the surface 52 (FIG. 2) is very preferably not at a right angle to the adjacent unrouted outer surface region of the guitar, being instead at an angle of (preferably) about eighty-eight degrees thereto. This is the result of the above-described inclination toward the main body of the end walls of the routed regions. The same is true on the other side of the guitar, wall 51 being at an angle of preferably eighty-eight degrees to the adjacent outer unrouted surface regions of the guitar neck.

When pin 37 is forced into bore 39, the corners 53,54 become crushed tightly against corners 56,57. This creates fine lines that extend vertically and that are visible when looking at opposite sides of the joint at the ends of walls 42,43. When the adjacent regions of the neck and walls 42,43 are sanded, these lines to not disappear (form holes) because, preferably, the taper of end walls 51,52 is only a few degrees (such as the exemplary two degrees stated above).

It is pointed out that the walls 42 have thicknesses and configurations that (except at bevelled surfaces 47,47*a*) correspond generally to the shape of the routed-out or indented side and end regions 16 of the neck. When the neck is fully mounted on the body, the exterior surfaces are flush and smooth; discrepancies such as at walls 47 and at the end of the tongue are not visible.

SUMMARY OF THE METHOD

Many necks are manufactured in accordance with U.S. Pat. No. 4,557,174. Many solid bodies are made in conventional manner, with neck-receiving pockets each adapted to receive the neck end shown in FIG. 7, which neck end is secured thereto by screws. Many other bodies are made as described in the present application, for example relative to FIG. 3. Except for the changed regions shown in FIG. 3, the last-mentioned bodies are identical to conventional solid bodies (to which necks are screw connected in conventional manner).

To produce solid-body guitars having glued on necks, the manufactured necks are subjected to two additional steps. The first is the formation of the routed-out indented side and end regions 16 described in detail above. The second is providing the combination bearing and cam pin 37 in a bore 36 therefor.

The tongue 19 is lightly sanded on the parallel side 26—parallel to its center line—to remove any imperfections and "fuzz". The side 27 of tongue pocket 21 is also thus lightly sanded.

The tapered side 24 of the tongue 19, and the associated tapered side 25 of pocket 21, are sanded (with a flat sander) to whatever extent is needed to cause the tongue 19 to fit correctly in the pocket 21. Sanding is not always needed. "Correctly" means, as described in detail above, to such an extent that the tongue 19 may be manually introduced into pocket 21 just until there is the above-indicated offset O (FIG. 4).

If the tongue is insertable too far into its pocket, glue-absorbing shims are provided flatwise on the surface 24 or 25.

Wood glue is applied to all surfaces that are to be adjacent each other, both on the neck and the body. After the glue is applied, the tongue 19 moved about half way into the pocket 21, without contacting the body, and then is moved downwardly until the bottom surface of pin 37 rests on surface 35. Then, the neck is moved longitudinally inwardly until the neck is seated in the pocket—except that the bottom surface 34 is spaced above surface 35 by the length of the protruding portion of pin 37.

Then, the above-described operation by which pin 37 is pressed into bore 39 is performed, which shifts the neck further to the right by the offset distance O (FIG. 4) and holds it there during the time the glue dries. The pin 37 also cooperates with the glue, after drying of the glue, in the maintaining of a very strong joint. The C-clamp is employed to press down the upper surface of the fretboard and to press up on the bottom surface of the body; no other clamp is required.

During the described operation, the glue (adhesive) migrates and extrudes, and some permeates the pores in the wood. There is wood-to-wood contact between surfaces 24,25; 26,27; 32,33; and 34,35.

To prevent hydraulic action and assure that there is wood-to-wood contact, vertical grooves or "divots" are provided in the tongue in spaced relationship, as indicated at 58. The glue is shown in the divots in FIGS. 5 and 6, being indicated by the reference numeral 59. It is to be understood that some other glue, not shown, is present near the inner end of the tongue, in the cavities adjacent surfaces 47 and 47*a*, etc.

The preferred adhesive is cabinet glue, called yellow glue, which is aliphatic resin.

The above-described "crushing" action creates the fine-line joints at edges 53,56,54,57, as described in detail in the preceding section. These are sanded, and because of the stated angle the sanding is not harmful.

Figure 8:
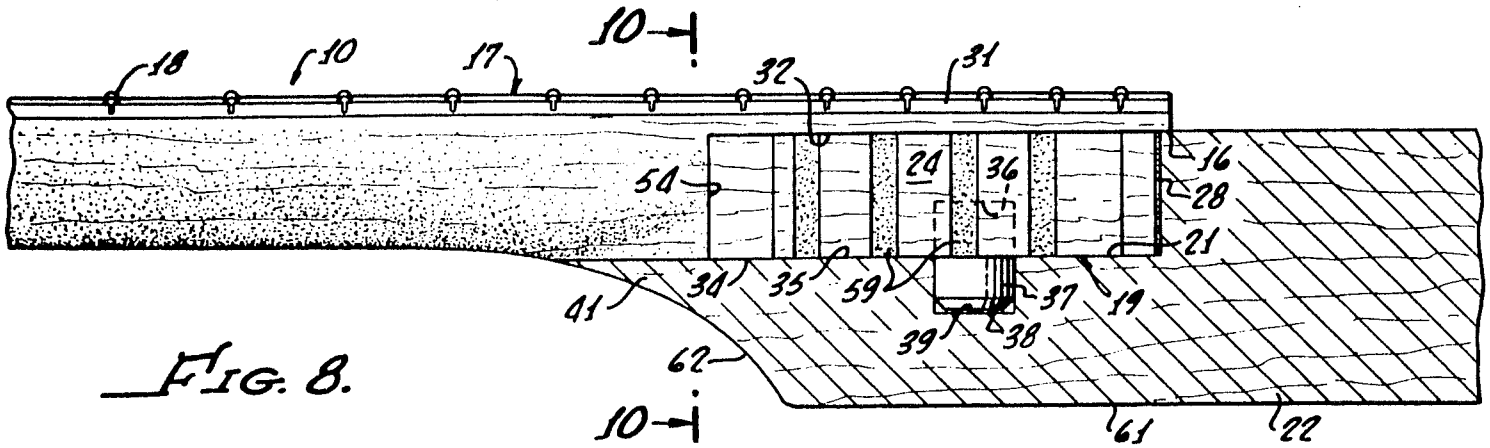
FIG. 8 is a view corresponding to FIG. 6 but showing the configuration after regions of the guitar body and guitar neck, at the joint therebetween, have been carved.
Figure 9:
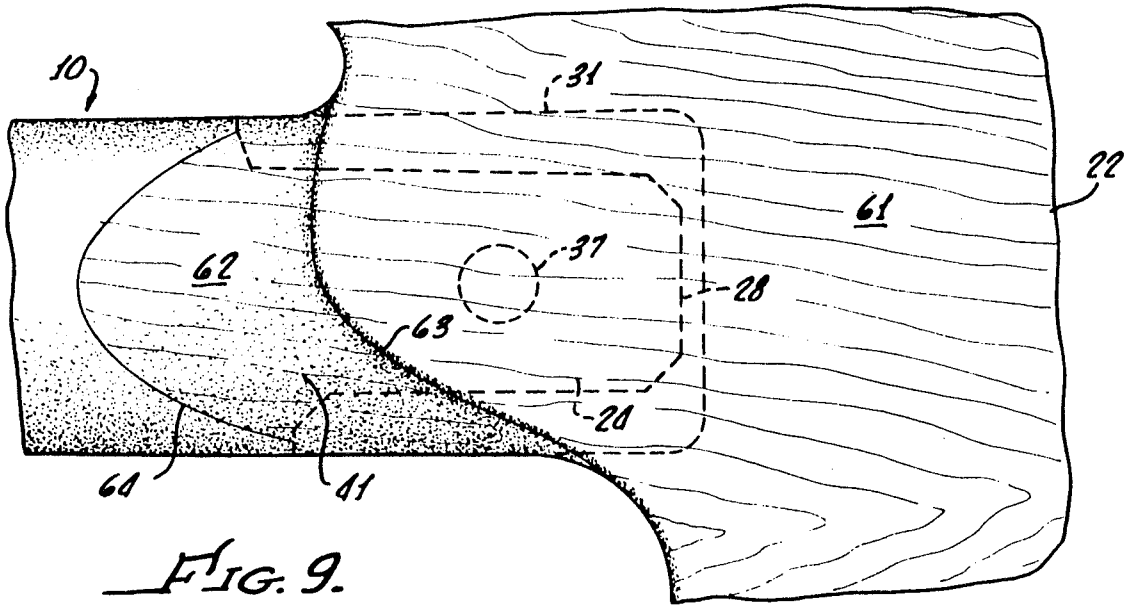
FIG. 9 is a bottom plan view of the right and central regions of the showing of FIG. 8.
Figure 10:
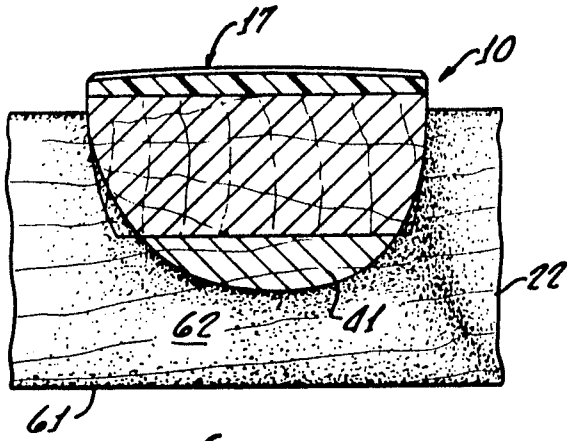
FIG. 10 is a sectional view on line 10—10 of FIG. 8, the truss rod means being unshown.

After the glue has set, the protuberance 41 is carved back in order to achieve the end configuration shown in FIGS. 8–10. The neck is also carved at the region adjacent the body, to achieve the smooth curved configuration shown in FIG. 10.

To state the above more fully, the bottom of guitar body 22 has a planar surface 61. After the glue has set in the joint, a large part of the protuberance 41 is carved off to form the rounded concave-convex surface shown at 62 in FIGS. 8–10. Surface 62 meets the planar bottom 61 of body 62 at curved line 63 (FIG. 9). The joint line between surface 62 and neck 10 is the curved line 64 (FIG. 9).

As above indicated, the carving includes regions of neck 10 relatively adjacent the body. The result is a continuous and seemingly "integral" look at the joint between neck and body. Furthermore, and very importantly, the relationships are such that the guitarist may reach frets that are very close to the bridge. Because of the very substantial carving back of protuberance 41, the left hand of the guitarist is able to move up the neck until it is relatively close to the bridge. This carving back cannot be done in a guitar whose neck is mounted by screws, because the joint would not be strong.

The guitar is then finished and provided with hardware, etc.

It is to be understood that in some guitars the center line of the body is not the same as the center line of the bridge. In such guitars, the center line of the bridge is what is referred to by "center line of the body".

The foregoing detailed description is to be clearly understood as given by way of illustration and example only, the spirit and scope of this invention being limited solely by the appended claims.

What is claimed is:

1. A guitar, which comprises:

(a) a wooden body,
 said body having a wooden protuberance at one end thereof,
  said protuberance having an outer portion and an underside,
 said protuberance and said body having a tongue pocket therein,
  said pocket extending to said outer portion of said protuberance, (b) an elongate neck,
 said neck having an upper side and an underside, and having an outer end and an inner end,
 said neck having a wooden tongue formed on said underside of said inner end thereof, longitudinally of said neck,
  said tongue being sized to seat in said pocket so that surfaces of said tongue may be adhesively secured to surfaces defining said pocket,
 said neck having a fretboard on said upper side thereof,
  said fretboard having frets thereon, said fretboard being substantially wider than said tongue at said inner neck end, said neck and said body having center lines, and (c) means to adhesively secure surfaces of said tongue to surfaces defining said pocket, in wedge relationship in such manner that said center lines of said neck and body are substantially coincident with each other.

2. The invention as claimed in claim 1, in which said protuberance extends up to said underside of said neck, said underside of said protuberance being carved back so as to facilitate contacting of those of said frets that are relatively remote from said outer end of said neck.

3. The invention as claimed in claim 1, in which said tongue pocket is defined in part by two walls that are part of said protuberance, said walls being at least portions of sidewalls of said tongue pocket, said walls having outer and inner surfaces.

4. The invention as claimed in claim 3, in which said outer surfaces of said walls are flush with the respective side surfaces of the inner end portion of said neck.

5. The invention as claimed in claim 4, in which said outer surfaces of said walls are flush with the respective side surfaces of the inner end portion of said neck, and in which said outer surfaces of said walls are also respectively flush with adjacent portions of said protuberances below said walls.

6. The invention as claimed in claim 1, in which said neck is substantially the same as necks that are employed on solid-body electric guitars wherein the necks are secured by screws, not glued, to the solid bodies, except that said inner end of said neck is peripherally routed-out at regions below said fretboard to form said tongue.

7. An electric guitar, comprising:

(a) a solid wooden body,
 said body having a wooden protuberance at one end thereof,
  said protuberance and said body having an upper side,
  said protuberance and said body having a tongue-receiving pocket in said upper side thereof,
  said pocket extending longitudinally of said protuberance,
  said pocket being defined in part by sidewall means, (b) an elongate wooden neck,
 said neck having an inner end, and also having an upper side, and an underside,
 said neck having a tongue formed longitudinally of said inner end thereof on said underside thereof,
  said tongue being adapted to seat snugly in said pocket,
 said neck having a fretboard on said upper side thereof and which is much wider than said tongue,
  parts of said fretboard being disposed above said sidewall means when said tongue is seated in said pocket, and (c) means to secure said inner end of said neck to said protuberance with said tongue seated in said pocket,
 said means including a bearing element seated in both said tongue and said body.

8. The invention as claimed in claim 7, in which said last-named means comprises adhesive means.

9. The invention as claimed in claim 8, in which said sidewall means has outer and inner surface means, said outer surface means being flush with adjacent sidewall portions of said protuberance and of said neck.

10. The invention as claimed in claim 8, in which said neck has a truss rod therein, said truss rod having an end portion thereof disposed in said tongue.

11. The invention as claimed in claim 8, in which said tongue is wedge shaped, there being tapering of a side surface of said tongue in a direction away from a center line of said neck as the head end of said neck is approached.

12. The invention as claimed in claim 11, in which said bearing element is disposed snugly in bores in said body and in said inner end of said neck, and is disposed to hold said tongue wedged tightly in said pocket.

13. The invention as claimed in claim 12, in which said bearing element has cam means thereon to tighten the wedge engagement between said tongue and surfaces of said pocket.

14. A guitar having a set neck, which comprises:

(a) a guitar body,
 said body having an elongate pocket therein,
  said pocket having an outer portion,
  said pocket having an open end at said outer portion thereof,
  said pocket being oriented substantially in a predetermined direction that it is desired the neck extend, (b) an elongate guitar neck,
 said neck having an inner end, and having a center line,
 said neck having a portion, at said inner end thereof, adapted to seat snugly in said pocket, and (c) adhesive means to secure surfaces of said neck portion to surfaces of said pocket, characterized in that said neck portion has one side substantially parallel to said center line of said neck, and another side that diverges gradually away from said center line, further characterized in that said pocket has one side substantially parallel to a center line of said guitar body, and another side that diverges gradually away from said center line of said guitar body, further characterized in that both of said diverging sides are at substantially the same angle to their respective center lines, and further characterized in that said neck portion is wedged into said pocket and adhesively held there, with said parallel sides closely engaged with each other and said diverging sides closely engaged with each other, whereby to cause said neck and said guitar body to be aligned with each other with their center lines substantially coincident with each other.

15. The invention as claimed in claim 14, in which said parallel sides are exactly parallel to said respective center lines.

16. The invention as claimed in claim 14, in which said diverging sides diverge, relative to their respective center lines, in directions toward the head end of said neck.

17. The invention as claimed in claim 14, in which said neck has an underside, in which said neck portion is an elongate tongue that is substantially parallel to said neck, said tongue being formed on said underside of said inner end of said neck.

18. The invention as claimed in claim 14, in which combination bearing and cam means are provided at connected adjacent regions of said body and neck, to cam said surfaces into tight bearing engagement with each other, and to cooperate with said adhesive means in strengthening the joint between said neck and said body.

19. The invention as claimed in claim 14, in which each angle of divergence is about two degrees.

20. A combination guitar neck and guitar body, comprising:

(a) a guitar body, (b) an elongate guitar neck having an inner end adapted to overlap a part of said body, (c) first means on said body and second means on said inner end of said neck to come into engagement with each other and thus limit the amount of said overlapping, said coming into engagement occurring when said neck is moved in a direction longitudinally of itself, and (d) means, responsive to movement of said inner end of said neck in a direction transverse to said longitudinal direction, to force said second means more tightly against said first means and thus somewhat increase the amount of overlapping of said inner and of said neck relative to said part of said body.

21. The invention as claimed in claim 20, in which said neck and body are formed of wood.

22. The invention as claimed in claim 21, in which adhesive means are provided to maintain said neck and said part of said body in said increased overlap relationship.

23. The invention as claimed in claim 21, in which said first means and said second means are shaped to cooperate with each other in wedge relationship, and with the degree of wedging increasing with the amount of said overlapping.

24. The invention as claimed in claim 21, in which said last-named means is a pin adapted to fit snugly in holes in said neck and body, said pin having cam surface means thereon adapted to cooperate in cam relationship with a wall of one of said holes.

25. The invention as claimed in claim 21, in which said first means and said second means are shaped to cooperate with each other in wedge relationship, and with the degree of wedging increasing with the degree of overlapping, and in which said last-named means is a pin adapted to fit snugly in holes in said neck and body, said pin having cam surface means thereon adapted to cooperate in cam relationship with a wall of one of said holes.

26. The invention as claimed in claim 25, in which said cam surface means is a bevel on an outer end of said pin, the remainder of said pin being cylindrical, and in which said pin has a relatively large diameter so as to present large bearing surfaces to said neck and body.

27. The invention as claimed in claim in which grooves are provided in spaced relationship in said surfaces, said grooves being transverse to said surfaces and being adapted to hold adhesive that migrates during insertion of said tongue into said pocket.

28. The invention as claimed in claim 14, in which grooves are provided in spaced relationship in said surfaces, said grooves being transverse to said surfaces and being adapted to hold adhesive that migrates during insertion of said neck portion into said neck pocket.

29. The invention as claimed in claim 20, in which edge portions of said neck and body are adapted to be brought forcibly together in response to said forcing, said edge portions being on generally coplanar regions of said neck and body, whereby said forcible contact creates a close joint having good aesthetics.

30. The invention as claimed in claim 29, in which at least one of said corners is a "crush" region adapted to be compressed in response to said cam action, to further enhance said aesthetics.

* * * * *

UNITED STATES PATENT AND TRADEMARK OFFICE

CERTIFICATE OF CORRECTION

PATENT NO. : 5,125,311

DATED : June 30, 1992

INVENTOR(S) : Boulanger et al.

It is certified that error appears in the above-identified patent and that said Letters Patent is hereby corrected as shown below:

Claim 4 (column 9, line 57), delete "the" and substitute therefor ---said---.

Claim 4 (column 9, line 57), delete "portion".

Claim 5 (column 9, line 60), delete "the" and substitute therefor ---said---.

Claim 5 (column 9, line 60), delete "portion".

Claim 20 (column 12, line 2), delete "and" and substitute therefor ---end---.

Claim 27 (column 12, line 34), after "claim", insert ---1,---.

Claim 30 (column 12, line 52), delete "corners" and substitute therefor ---edge portions---.

Signed and Sealed this

Twenty-fourth Day of August, 1993

Bruce Lehman

*Attest:*

BRUCE LEHMAN

*Attesting Officer*

*Commissioner of Patents and Trademarks*